United States Patent [19]

Lien et al.

[11] 4,158,791

[45] Jun. 19, 1979

[54] HELIX TRAVELING WAVE TUBES WITH RESONANT LOSS

[75] Inventors: Erling L. Lien; Allan W. Scott, both of Los Altos, Calif.

[73] Assignee: Varian Associates, Inc., Palo Alto, Calif.

[21] Appl. No.: 767,239

[22] Filed: Feb. 10, 1977

[51] Int. Cl.[2] ..... H01J 25/34

[52] U.S. Cl. ..... 315/3.5; 315/3.6; 330/43

[58] Field of Search ..... 315/3.5, 3.6; 330/43

[56] References Cited

U.S. PATENT DOCUMENTS

| | | | |
|---|---|---|---|
| 2,900,557 | 8/1959 | Webber et al. | 315/3.6 |
| 3,293,482 | 12/1966 | Wolkstein | 315/3.6 X |
| 3,368,103 | 2/1968 | Thall | 315/3.5 |
| 3,397,339 | 8/1968 | Beaver et al. | 315/3.6 |
| 3,401,298 | 9/1968 | Dix | 315/3.6 |
| 3,666,984 | 5/1972 | Kantorowicz | 315/3.6 |
| 3,670,197 | 6/1972 | Unger | 315/3.6 |
| 3,832,593 | 8/1974 | Gross | 315/3.6 |

*Primary Examiner*—Saxfield Chatmon, Jr.
*Attorney, Agent, or Firm*—Stanley Z. Cole; Richard B. Nelson

[57] ABSTRACT

To suppress spurious oscillations in a helix-type traveling wave tube (TWT), frequency-sensitive loading is produced by a lossy resonant circuit attached to a dielectric support and coupled to the fields of the interaction circuit. The lossy circuit is resonant near the band-edge frequency. It may be a section of delay line with reflective terminations. In one embodiment, it is a metallized pattern on a dielectric rod used to support the helix.

18 Claims, 8 Drawing Figures

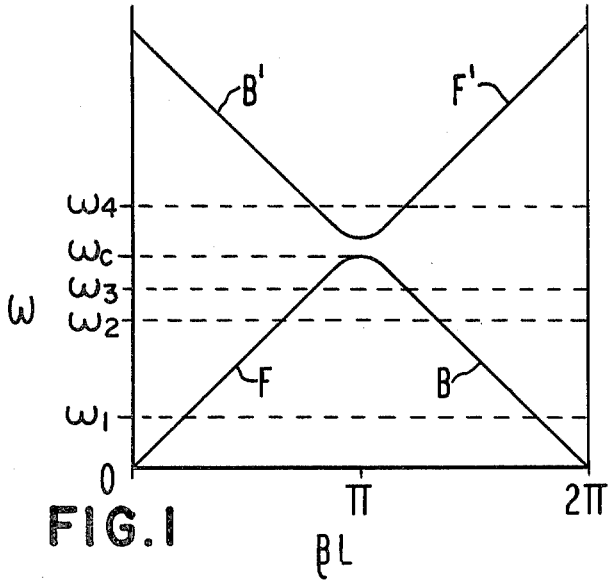
FIG.1
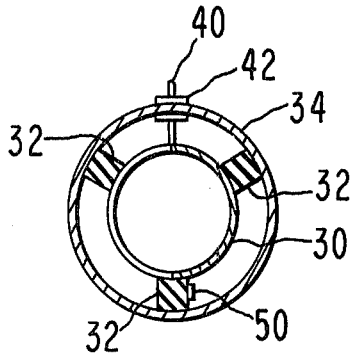
FIG.3
FIG.2
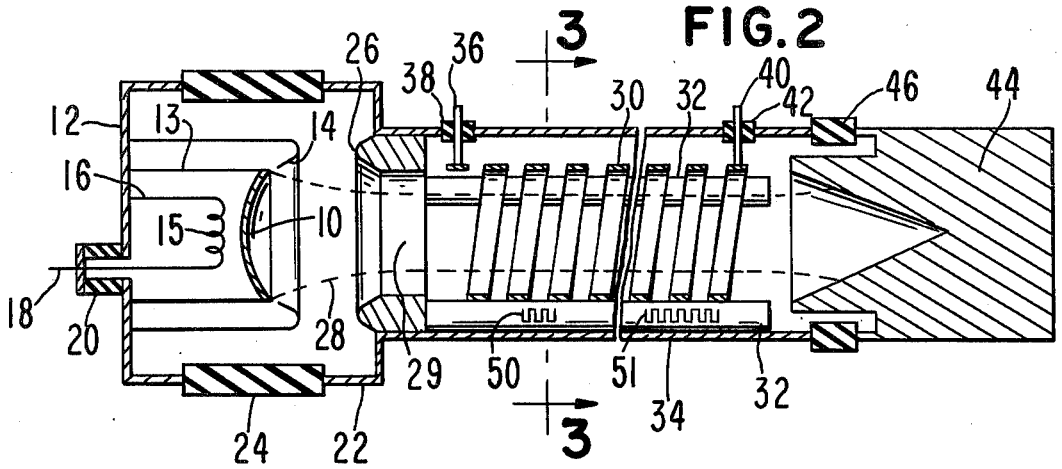
FIG.4
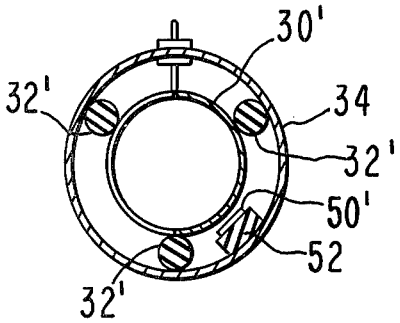
FIG.5
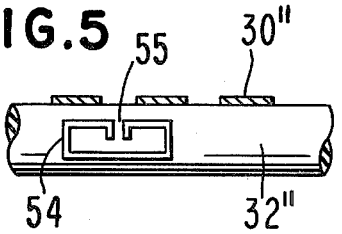
FIG.6
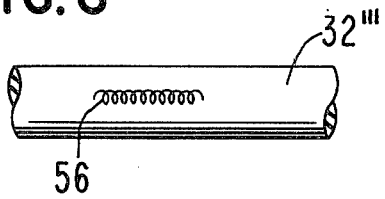

HELIX TRAVELING WAVE TUBES WITH RESONANT LOSS

FIELD OF THE INVENTION

The invention pertains to broad-band traveling-wave tubes (TWT's), particularly tubes using interaction circuits of the helix-derived type. In all broad-band TWT's, particularly at high power levels, problems arise with instabilities and oscillations at frequencies near the band edges of the circuits where the wave group velocity becomes very small and the interaction impedance correspondingly large.

PRIOR ART

Two basic techniques have been widely used to combat instabilities in TWT's. One is to sever the slow-wave interaction circuit, dividing it into a plurality of shorter circuits with no wave coupling between them so that the gain in any one circuit section is restricted to values below that at which oscillation may occur. Severs have serious disadvantages in that considerable signal gain is lost by throwing away the circuit wave energy and starting a new wave in the following section. Also, limiting the gain in the output section involves a compromise with loss of efficiency when the output section is too short.

A second technique very widely used in helix-type TWT's is to provide wave attenuation distributed over a length of the circuit, to limit the gain and absorb unwanted backward-reflected waves. Such distributed attenuation absorbs power at all frequencies across the operating band of the tube. It therefore creates problems, particularly in high power tubes, in dissipating the absorbed energy, in reducing the gain and in reducing the efficiency.

In high power TWT's using bandpass circuits such as coupled cavities, it has been common to provide circuit attenuation which is frequency selective so as to be greatest near a band-edge frequency. This has sometimes been done by coupling lossy resonant elements such as hollow cavities to the interaction circuit cavities. U.S. Pat. No. 3,594,605 issued July 20, 1971 to C. E. Blinn illustrates resonant cavity loading. This technique has not been practical for tubes with helix-type circuits because it would be quite difficult to couple such elements to the helix which has a low electromagnetic field outside of its sheath. Also, helix-type TWT's are generally required to fit inside small bores in beam-focusing magnets, so there is no room for a bulky attenuator such as a resonant cavity.

SUMMARY OF THE INVENTION

An objective of the invention is to provide a helix-type TWT with frequency sensitive loss without increasing the tube diameter.

A further objective is to provide a helix-type TWT in which spurious oscillations and instabilities near a band-edge frequency are suppressed.

A further objective is to provide a stable TWT which is small, light-weight and simple to manufacture.

The above objectives are achieved by including one or more lossy resonant circuit elements inside the vacuum envelope of the TWT and coupled to the electromagnetic field of the interaction circuit. The lossy circuit is attached to a dielectric support which may be one of the dielectric rods used to support the helix. In a preferred embodiment, the lossy circuit is a section of delay line with reflective terminations, of sufficient length to resonate at the desired frequency.

BRIEF DESCRIPTION OF THE FIGURES

FIG. 1 is a dispersion diagram for a helix-type slow wave circuit.

FIG. 2 is a schematic section through the axis of a TWT using a helix circuit.

FIG. 3 is a section perpendicular to the axis of the TWT of FIG. 2.

FIG. 4 is a section similar to FIG. 3 illustrating an alternative embodiment of the invention.

FIG. 5 is an enlarged section of a portion of a TWT similar to that in FIG. 2 with an alternative lossy resonant element.

FIG. 6 is an enlarged portion illustrating still another embodiment.

DESCRIPTION OF THE PREFERRED EMBODIMENT

Figure 7:
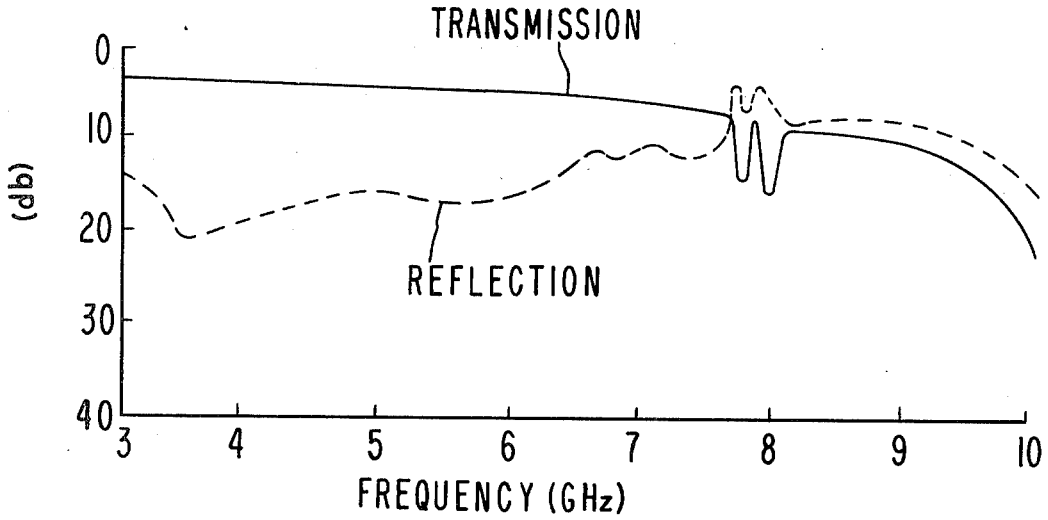
FIG. 7 is a graph of the wave transmission and reflection of a helix circuit without resonant loss.

FIG. 1 shows the well-known $\omega$–$\beta$ or dispersion diagram of a slow-wave interaction circuit such as a helix or helix-derived circuit. Helix-derived circuits include multiple-conductor helices such as the interlaced bifilar helix, the contra-wound helix and its topographical equivalent, the ring-and-bar circuit. These circuits have no dc ground connection. They propagate frequencies down to zero, (i.e. dc). The abscissa in FIG. 1 is $\beta L$, that is, the phase shift in radians of the transmitted wave per period of the circuit, that is, per pitch of the helix. The ordinate is $\omega$, the transmitted frequency. The fundamental, lower branch of the dispersion curve consists of a portion F of positive slope indicating a forward wave and a portion B of negative slope representing a backward wave. The usual convention concerning directions is that increasing phase shifts are taken in the direction of the TWT beam propagation. Since the slow-wave circuit propagates identically in both directions, the dispersion diagram is symmetric about $\beta L=\pi$. If there were no coupling between a forward wave and a backward wave, the forward-wave portion F would simply continue as F′, crossing the backward-wave characteristic B continuing as B′. However, there are in fact always some asymmetries which intercouple the waves. This causes the two branches to separate instead of intersecting, giving a cutoff frequency $\omega_c$ for the fundamental branch at $\beta L=\pi$. At cutoff, the wave group velocity becomes zero, shown by the dispersion curve becoming horizontal. Since energy is not propagated down the helix, its interaction impedance becomes very large for frequencies in the neighborhood of cutoff. The resulting strong interaction with the electron beam causes instabilities and possibly oscillation near the cutoff frequency. Indicated in FIG. 1 are the range of operating frequencies from $\omega_1$ to $\omega_2$ and the range of higher frequencies from $\omega_3$ to $\omega_4$ in which instabilities are found. An objective of the present invention is to strongly attenuate waves having frequencies in the instability range without appreciably attenuating waves in the operating range. For this, an attenuating device with a selective frequency dependence is required.

FIG. 2 is a simplified schematic section of a TWT incorporating the present invention. A beam of electrons is drawn from thermionic cathode 10 such as a conventional barium oxide cathode on a nickel base. Cathode 10 is typically of concave spherical shape supported on a base 12 by an electrically conducting but thermally isolating support member 13. Surrounding cathode 10 is a beam focus electrode 14, also supported on base 12. Cathode 10 is heated by radiation from a filamentary heater 15, typically tungsten wire insulated with an alumina coating. One leg 16 of heater 15 is joined to base 12, and the other leg 18 is brought out through the vacuum envelope for external connection via an insulating seal 20. Base 12 is sealed to the main vacuum envelope 22 by a high voltage insulator 24. Inside envelope 22 a projecting anode electrode 26 operated at a dc potential positive to cathode 10 draws the electron beam 28 from cathode 10, converging it through an aperture 29 in anode 26 and projecting it as a cylindrical beam. Beyond anode 26 the beam 28 is typically kept focused by an axial magnetic field produced by a solenoid or a permanent magnet system (not shown). Beam 28 passes inside a slow-wave interaction circuit 30 which is designed to propagate an electromagnetic wave at a velocity synchronous with the velocity of the electron beam 28. Circuit 30 illustrated in FIG. 2 is the simplest and most widely used type—a metallic tape of rectangular cross-section wound into a helix. Circuit 30 is supported along its length by a plurality of axially extending dielectric rods 32, as of sapphire or alumina ceramic. The support may be purely mechanical containment or alternatively rods 32 may be joined to circuit 30 by bonding glass. Support rods 32 are mechanically contained inside a cylindrical portion 34 of the vacuum envelope, typically of a non-magnetic metal such as austenitic stainless steel. Suport rods 32 may be circular cylinders, suitable for low-power TWT's, or in high-power tubes may, as shown in FIG. 3, have a generally rectangular cross section with inner and outer surfaces curved to fit the helix and the tube envelope for improved thermal conduction. The ends of helix 30 are connected to external transmission lines by metallic pins 36, 40 welded to the ends of helix 30 and extending through vacuum envelope 34 via insulating dielectric seals 38, 42. In a forward-wave TWT amplifier, the input signal would be applied to input terminal 36 and the amplified output would be removed through output terminal 40. After leaving helix 30, electron beam 28 enters a hollow metallic collector 44 and the current is removed by an external power supply (not shown). Collector 44 is mounted on envelope 34 via a dielectric vacuum seal 46, as of alumina ceramic, thereby completing the vacuum envelope.

On at least one of support rods 32 is affixed the frequency-sensitive lossy attenuating member 50 which is the heart of the present invention. In FIG. 2 the lossy element 50 is illustrated as a meander line formed of a strip of resistive conductor bonded to the surface of support rod 32. Flat side surfaces on rods 32 (FIG. 3) are well adapted for depositing the attenuator 50. Strip 50 may be formed by any of the well-known techniques for depositing a metallized pattern on the ceramic. For example, bonding metal such as chromium may be sputtered onto the rod through a mask to form the desired pattern and then additional metal may be electroplated to increase the thickness. Alternatively, a powdered metallizing paint comprising molybdenum and manganese powders may be deposited as by a silk screened pattern. Alternatively a preformed metallic conductor element 50 may be affixed as by glazing to the dielectric rod. Meander line 50 is a slow-wave circuit. Its electrical length is selected to resonate at the frequency to be suppressed as an open-ended transmission line N/2 electrical wavelengths long, where N is any integer. When N=1 and the lossy line is ½ wavelength long, it is preferably made with physical length not greater than the helix pitch and centered between adjacent helix turns so that with $\pi$ phase shift between turns line 50 is in a unidirectional field. An alternative lossy line 51 is shown bridging two helix turns. It would preferably be one full wavelength long to be excited in full-wave resonance by the antiphased fields of the $\pi$ mode on the helix. The length of the lossy element is selected to provide the desired degree of coupling of the electromagnetic fields of the slow-wave interaction circuit.

In FIG. 3 lossy circuit 50 is shown as lying on the surface of a dielectric support rod 32.

FIG. 4 illustrates an alternative embodiment in which the lossy circuit element 50' is supported on an independent dielectric support bar 52 which in turn is supported inside envelope 34'. The construction shown in FIG. 4 allows the area of surface for supporting lossy element 50' to be as large as desired.

FIG. 5 shows an alternative embodiment of the resonant lossy element. Here a conducting strip 54 is shaped as a resonant ring including a capacitive gap 55.

FIG. 6 illustrates still another embodiment wherein a small metallic helix, as of tungsten wire, is affixed to support rod 32''' as by glazing. The slow-wave helix circuit 56 is chosen in dimensions to have an open-circuit resonance at the frequency to be supressed. That is, it will generally be N/2 electrical wavelengths long.

FIG. 7 shows the transmission and reflection characteristics of a typical helix circuit. This particular circuit had a stop-band at around 7.8 GHz. A TWT with this output circuit tended to oscillate.

Figure 8:
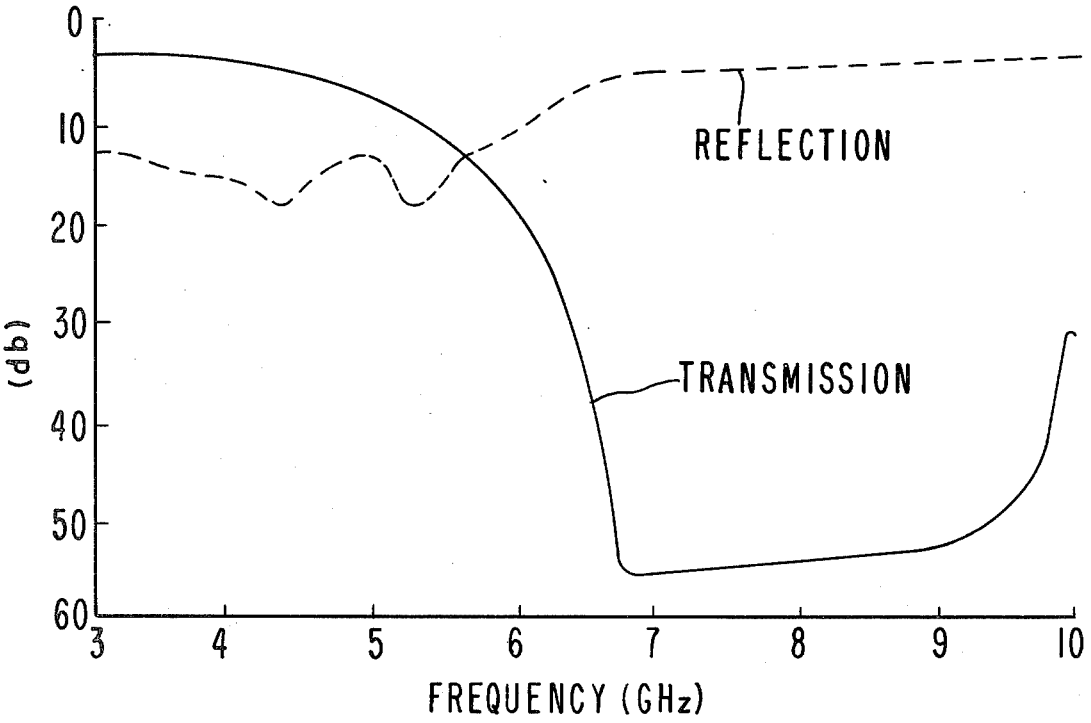
FIG. 8 is a graph similar to FIG. 7 for a helix with resonant loss.

FIG. 8 shows the characteristics of the same circuit as FIG. 7 with the addition of loss circuits resonant at 7.2 GHz and 8.2 GHz. The instability frequencies were highly attenuated, and a TWT with this circuit was quite stable.

While the embodiments of the invention described above are intended to be illustrative and not limiting, many variations will be obvious to those skilled in the art. For example, any of the family of helix-derived slow-wave circuits may be used as the interaction circuit. Also, many forms of delay line and other resonant circuits may be used as the frequency-sensitive loss element, and various means of supporting the loss element will become apparent. For best results it is believed that lossy elements should be symmetrically disposed with respect to each circuit support element so that the loss elements themselves do not give rise to a stop band. It is also foreseen that a plurality of loss elements may be disposed on each support. The invention is intended to be defined only by the following claims and their legal equivalents:

We claim:

1. In a traveling wave tube comprising a helix-type slow wave interaction circuit supported by dielectric support rod extending in the direction of propagation, frequency sensitive loss means for absorbing wave energy flowing on said interaction circuit within a certain range of frequencies, said loss means comprising resistive conductor means affixed to a dielectric support member and shaped to form a resonant slow-wave circuit extending in said direction of propagation with wave-reflective ends.

2. The tube of claim 1 wherein said interaction circuit is adapted to interact with an electron beam over a selected range of frequencies and said resonant circuit is resonant at a frequency outside said range.

3. The tube of claim 2 wherein said resonant frequency is near a band edge of said interaction circuit.

4. The tube of claim 1 wherein said wave-reflective ends are open circuits.

5. The tube of claim 1 wherein said resonant circuit is a section of slow-wave circuit with open-circuit ends and an integral number of electrical half-wavelengths long at said resonant frequency.

6. The tube of claim 1 wherein said resonant circuit propagates electromagnetic waves substantially in the direction of propagation of said interaction circuit.

7. The tube of claim 1 wherein said resonant circuit is affixed over substantially its entire length to said dielectric support.

8. The tube of claim 1 wherein said resonant circuit is shaped as a meander line.

9. The tube of claim 1 wherein said conductor is a metallized pattern on said dielectric support.

10. The tube of claim 1 wherein said dielectric support is a bar extending axially parallel to said interaction circuit and disposed circumferentially between two dielectric support rods of said interaction circuit.

11. The tube of claim 1 wherein said interaction circuit lies on a right circular cylinder.

12. In a traveling-wave tube comprising a helix-type slow wave interaction circuit, a combined means for providing both dielectric support of said interaction circuit and frequency sensitive loss for absorbing and suppressing energy within a certain range of frequencies, comprising: a dielectric rod supporting said interaction circuit having affixed thereto a resistive conductor shaped to form a resonant slow wave circuit extending in the direction of propagation of said interaction circuit.

13. The tube of claim 12 wherein said support rod is positioned between said circuit and a surrounding vacuum envelope.

14. The tube of claim 13 wherein said vacuum envelope is metallic.

15. The tube of claim 14 wherein the interior of said envelope is a right circular cylinder.

16. The tube of claim 13 comprising a plurality of support rods positioned between said circuit and said envelope and spaced apart.

17. The tube of claim 16 wherein said dielectric support and said support rods are cylinders extending axially parallel to said interaction circuit, and said dielectric support is spaced outside said circuit and between two of said support rods.

18. The tube of claim 14 wherein said loss circuit is affixed to said support rod insulated from said interaction circuit and said envelope.

* * * * *